US010014596B2

(12) United States Patent
Hartmann

(10) Patent No.: US 10,014,596 B2
(45) Date of Patent: Jul. 3, 2018

(54) CONDUCTOR TERMINAL

(71) Applicant: WAGO Verwaltungsgesellschaft mbH, Minden (DE)

(72) Inventor: Frank Hartmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 15/567,778

(22) PCT Filed: May 19, 2016

(86) PCT No.: PCT/EP2016/061190
§ 371 (c)(1),
(2) Date: Oct. 19, 2017

(87) PCT Pub. No.: WO2016/184934
PCT Pub. Date: Nov. 24, 2016

(65) Prior Publication Data

US 2018/0076536 A1 Mar. 15, 2018

(30) Foreign Application Priority Data

May 19, 2015 (DE) ..... 10 2015 107 853

(51) Int. Cl.
*H01R 4/48* (2006.01)
*H01R 4/50* (2006.01)
(Continued)

(52) U.S. Cl.
CPC ..... *H01R 4/4845* (2013.01); *H01R 4/4827* (2013.01); *H01R 4/4836* (2013.01);
(Continued)

(58) Field of Classification Search
CPC .. H01R 4/4845; H01R 4/4827; H01R 4/4836; H01R 4/22; H01R 12/88; H01R 12/728; H01R 13/50
See application file for complete search history.

(56) References Cited

U.S. PATENT DOCUMENTS 4,768,981 A 9/1988 Hohorst
5,158,475 A 10/1992 Tyler
(Continued)

FOREIGN PATENT DOCUMENTS

CN 2653721 Y 11/2004
DE 83 01 933 U1 7/1983
(Continued)

*Primary Examiner* — Harshad C Patel
(74) *Attorney, Agent, or Firm* — Muncy, Geissler, Olds & Lowe, P.C.

(57) ABSTRACT

A conductor terminal with an insulating housing that has a conductor insertion opening for inserting an electrical conductor and a contact pin insertion opening for inserting a contact pin, with a clamping spring for clamping an electrical conductor, wherein the clamping spring has a clamping leg with a clamping edge oriented so as to rest against the electrical conductor to be clamped, has a spring bend, and has a support leg, wherein the conductor insertion opening leads to the clamping edge in order to guide the electrical conductor to a clamping point formed by the clamping edge, and wherein the contact pin insertion opening extends into the interior of the insulating housing in the opposite direction to the conductor insertion opening and leads to the support leg in order to guide the contact pin for clamping to the support leg.

12 Claims, 15 Drawing Sheets

Figure 1:
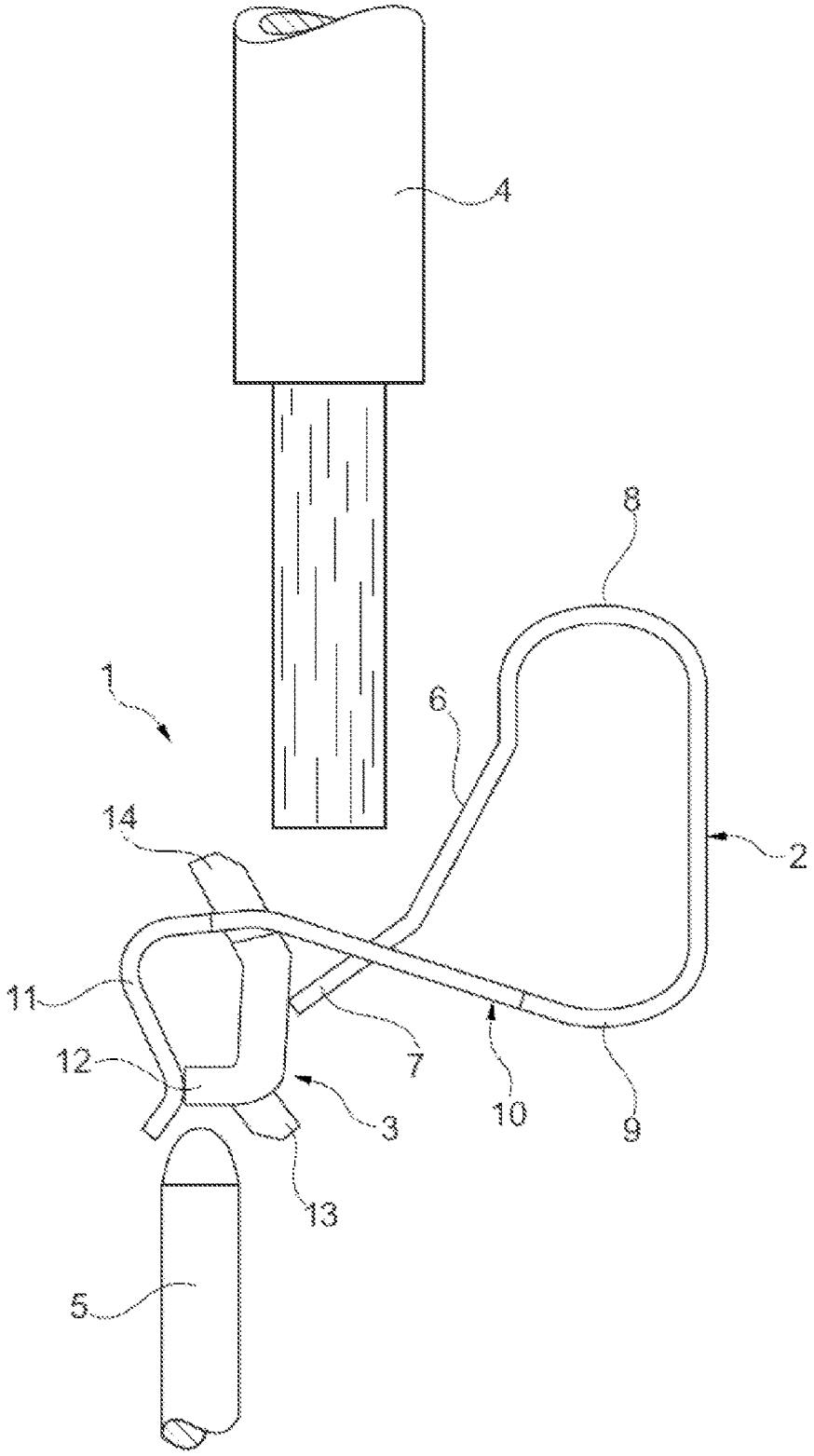

(51) Int. Cl.

| | |
|---|---|
| ***H01R 13/50*** | (2006.01) |
| *H01R 4/22* | (2006.01) |
| *H01R 12/72* | (2011.01) |
| *H01R 12/88* | (2011.01) |

(52) U.S. Cl.
CPC ..... *H01R 4/5066* (2013.01); *H01R 13/50* (2013.01); *H01R 4/22* (2013.01); *H01R 12/728* (2013.01); *H01R 12/88* (2013.01)

(56) References Cited

U.S. PATENT DOCUMENTS

| | | | | |
|---|---|---|---|---|
| 5,939,484 | A * | 8/1999 | Araki | C08K 5/17 524/492 |
| 7,988,504 | B2 | 8/2011 | Stromiedel | |
| 8,292,677 | B2 * | 10/2012 | Gassauer | H01R 13/15 439/729 |
| 9,466,895 | B2 | 10/2016 | Stromiedel | |
| 2009/0017704 | A1 * | 1/2009 | Koellmann | H01R 4/4845 439/834 |
| 2009/0215326 | A1 | 8/2009 | Breen, IV et al. | |
| 2015/0357727 | A1 * | 12/2015 | Gassauer | H01R 4/4845 439/751 |
| 2016/0248174 | A1 * | 8/2016 | Ludewig | H01R 4/4836 |

FOREIGN PATENT DOCUMENTS

| | | | |
|---|---|---|---|
| DE | 39 11 459 | A1 | 10/1990 |
| DE | 35 14 099 | C2 | 11/1994 |
| DE | 202 10 105 | U1 | 10/2002 |
| DE | 10 2010 028 790 | A1 | 11/2010 |
| DE | 20 2009 011 828 | U1 | 1/2011 |
| DE | 10 2010 010 260 | A1 | 9/2011 |
| DE | 20 2013 101 968 | U1 | 5/2013 |
| DE | 10 2009 035 716 | B4 | 3/2014 |
| DE | 10 2013 101 409 | A1 | 8/2014 |
| EP | 1 022 808 | B1 | 12/2001 |
| EP | 1 434 307 | A1 | 6/2004 |

* cited by examiner

CONDUCTOR TERMINAL

This application is a National Stage of International Application No. PCT/EP2016/061190, filed on May 19, 2016, which claims priority to German Application No. DE 10 2015 107 853.8 filed in Germany on May 19, 2015, the entire contents of all of which are hereby incorporated by reference.

The invention relates to a conductor terminal with an insulating housing that has a conductor insertion opening for inserting an electrical conductor and a contact pin insertion opening for inserting a contact pin, with a clamping spring for clamping the electrical conductor, wherein the clamping spring has a clamping leg with a clamping edge oriented so as to rest against the electrical conductor to be clamped, has a spring bend, and has a support leg, wherein the conductor insertion opening leads to the clamping edge in order to guide the electrical conductor to a clamping point formed by the clamping edge, and wherein the contact pin insertion opening extends into the interior of the insulating housing in the opposite direction to the conductor insertion opening and leads to the support leg in order to guide the contact pin to rest against the support leg, Conductor terminals of this nature are used to make screwless electrically conductive contact between electrical conductors and a contact pin with the aid of a spring-loaded terminal connection. The contact pin can, for example, be soldered into a printed circuit board and the conductor terminal can be pushed onto the printed circuit board having the at least one contact pin.

DE 10 2009 035 716 B4 discloses one such conductor terminal with a clamping spring bent in a U-shape that is supported by its support leg on the insulating housing. The free end of the clamping leg is oriented in the direction of an intermediate element that can optionally be placed in the insulating housing between the electrical conductor and the contact pin. The contact pin rests against the insulating housing on one side and against the intermediate plate on the other side.

EP 1 022 808 B1 shows a cage clamp with a pass-through opening in the clamping leg. A bus bar section projects through the pass-through opening in the clamping leg and has a terminal contact pin on its end projecting out of the insulating housing. An electrical conductor can be clamped between a clamping edge on the free end of the clamping leg and the bus bar section, as is customary with a cage clamp. Moreover, an additional entry opening is present above the conductor insertion opening in the insulating housing for the electrical conductor in order to connect a jumper between the support leg and the bus bar section on the opposite side of the electrical conductor on the bus bar section.

DE 39 11 459 A1 proposes for a cage clamp that the bottom edge of the recess forming on the clamping edge in the clamping leg for clamping an electrical conductor is shaped with a curve on both sides in order to form a conductor entry funnel and has a curved leading edge in the direction of conductor removal.

In addition, a connecting device for directly connecting conductor ends to a loop spring that has a feed-through opening in the support leg is known from EP 1 515 397 B1. The support leg rests on a bus bar section. Bent away from the bus bar section is a contact pin that is passed through the feed-through opening in order to clamp an electrical conductor between the contact pin and the clamping leg of the leg spring. The support leg with the window-like recess is immovably arranged on the bus bar in this design.

U.S. Pat. No. 5,158,475 A shows a spring terminal with a spring steel sheet that has, on its mutually opposite sides, two U-shaped leg springs oriented as mirror images of one another. These leg springs are provided in order to clamp one electrical conductor each between the applicable clamping leg and a common support leg of the double spring.

A comparable spring-loaded terminal is also described in DE 20 2009 011 828 U1.

DE 10 2010 028 790 A1 discloses a linear push-in wire connector with a housing containing at least two wire entry ports that each face in opposite directions. Located in the housing is a terminal assembly that has a bus bar located between the wire ports and a spring member. The spring member has two spring arms bent out of a spring steel sheet that are oriented towards the bus bar located between them. The bus bar is permanently connected to the spring steel sheet in this design.

DE 35 14 099 C2 shows a cage clamp, in which an inherently rigid bus bar is passed through the conductor feed-through opening in the clamping leg and is supported by means of an upturn on the support leg. The support is accomplished with two lateral upturns on the back end, between which an additional electrical conductor can be passed in order to make contact between the support leg and bus bar.

DE 10 2010 010 260 A1 shows a plug-in connector with a bus bar element and a leg spring bent in a U-shape. The support leg of the clamping spring projects into a contact pin receptacle of the bus bar element and exerts a spring force in the direction of an opposing contact surface of the bus bar element in order to make electrical contact with spring force between a contact pin inserted in an associated contact pin insertion opening and the bus bar element.

Based on this, it is the object of the present invention to create an improved conductor terminal with which the electrical contact of an electrical conductor to a contact pin is improved with as compact a design as possible.

The object is attained by the conductor terminal with the features of claim 1. Advantageous embodiments are described in the dependent claims.

It is proposed for a conductor terminal of the generic type that the support leg has a feed-through opening, an electrically conductive contact element is arranged on the clamping spring in the feed-through opening of the support leg between an inserted conductor and the inserted contact pin, and the free end section of the support leg forms a clamping section for clamping the inserted contact pin between the clamping section and the contact element.

The feed-through opening thus is not present in the clamping leg, but instead in the support leg of the clamping spring. This achieves the result that the contact element can be placed in the feed-through opening of the support leg in a space-efficient manner. The contact force exerted by the contact leg on an inserted electrical conductor presses the electrical conductor against the contact element located between them. Moreover, the opposite free end section of the support leg exerts a contact force on the inserted contact pin in the direction of the contact element located therebetween. Both the electrical conductor and the contact pin are thus connected directly to a contact element located between them.

With very compact construction, this results in a relatively short current transfer path between electrical conductor and contact pin through the contact element located between them. The clamping forces of the clamping spring act on the contact element from both sides through the contact pin and the electrical conductor. Moreover, the contact pin and the electrical conductor can be inserted independently of one another. Thus, it is possible to first place the conductor terminal on a contact pin and make contact with it, and then to insert and clamp the electrical conductor. The reverse is also possible, in which at least one electrical conductor is first clamped to the conductor terminal and then this conductor terminal, together with the already clamped electrical conductor, is pushed onto the associated at least one contact pin. The insulating housing does not contribute materially to the clamped connection here and in any case does not serve as a counter-support located opposite the clamping spring. Instead, the contact pin and the electrical conductor are clamped between the free end section of the support leg and the clamping edge on the free end of the clamping leg. The spring-loaded terminal connection is thus self-supporting, and independent of the insulating housing to the greatest extent possible.

It is especially advantageous if the clamping section is a section of the support leg that is bent away from the plane spanned ahead of the support leg in the region of the feed-through opening of the support leg. The free end section of the support leg provided for clamping the contact pin against the contact element is thus adjacent to the feed-through opening.

This free end section can either be bent in the insertion direction of the contact pin or opposite the insertion direction of the contact pin in this design. Bending the free end section opposite the insertion direction of the clamping leg causes the clamping force on the contact pin to be displaced relatively far ahead of the feed-through opening when viewed in the direction of contact pin insertion. In the other case, in which the free end section is bent in the direction of insertion of the contact pin, the contact force is displaced further upward above the feed-through opening when viewed in the direction of contact pin insertion. The particular variant should preferably be chosen in accordance with the positioning of the clamping edge on the clamping leg so that the contact forces of the support leg and of the clamping leg are oriented toward one another to the greatest degree possible.

It is advantageous if the contact element is arranged in the insulating housing in a fixed position or with a limited mobility. This ensures that the conductor insertion opening and the contact pin insertion opening in the insulating housing are not blocked by the contact element. The support leg is then movable relative to the contact element in order to press the inserted contact pin against the contact element that is arranged in the insulating housing in a fixed position. The same applies to the clamping leg, which is movable in the direction of the contact element due to the spring force of the clamping spring.

It is especially advantageous if the contact element has at least one contact projection on the contact side of the contact element facing the electrical conductor and/or the contact pin. As a result, the spring force exerted by the clamping spring through the clamped contact pin and/or electrical conductor is concentrated on the contact projection, and consequently the surface pressure is increased. The surface pressure is the contact pressure per area. The clamping force is thus concentrated on as small an area as possible, which significantly improves the reliability of the electrical terminal connection.

The contact element, unlike a bus bar used for conducting current, is relatively short and serves exclusively to transfer the electric current from the contact pin to the electrical conductor and vice versa. No provision is made for further conduction of the current, e.g. to a terminal contact of the conductor terminal connected to the contact element. The contact element is thus comparatively short. Preferably, it is connected in an electrically conductive manner solely to the clamping spring and, in the clamped state, to an electrical conductor and a contact pin. The contact element in this case is preferably shorter than the distance between the spring bend adjoining the support leg and the clamping section of the support leg. It is especially advantageous if the contact element has a length corresponding at a maximum to the width of the clamping spring.

The contact element preferably is pivotably supported in a fixed position in the feed-through opening. It thus has a predefined fixed position with respect to the conductor insertion opening and the contact pin insertion opening in the insulating housing. The pivotable support of the contact element on the support leg achieves the result that the contact element fits closely against an adjacent contact pin and electrical conductor when the contact pin and the electrical conductor are pressed together by the clamping force of the clamping spring. In this case, the spring forces on the contact pin and the electrical conductor generally do not act directly opposite one another. The pivotability of the contact element results in an optimal adaptation of the position of the contact element, optimizing the flow of forces and ensuring improved current conduction.

In another advantageous embodiment, the contact element can also be movably supported in the feed-through opening. Upon insertion of an electrical conductor and a contact pin, the contact element is thus able to optimally orient itself with regard to the spring clamping forces acting on the contact pin and electrical conductor.

It is advantageous for support of the contact element in the feed-through opening if the contact element has, on its mutually opposing faces, notches for accommodating the side webs of the support leg of the clamping spring that delimit the feed-through opening. The contact element thus is not simply inserted in the feed-through opening alone, but rather is supported on the side webs of the feed-through opening with the aid of the notches. As a result, it cannot slip in a direction perpendicular to the plane of the plane spanned by the feed-through opening. Instead, the contact element is fixed in position in this direction by the notches. Consequently, it is simply suspended in the feed-through opening by means of the notches.

The conductor terminal can be single-pole. However, it is also possible for the conductor terminal to be multipole and to have a number of clamping springs with associated conductor insertion openings and contact pin insertion openings that corresponds to the number of poles. Consequently, an indefinite article in the above description and in the claims is not to be understood as indicating a number.

Figure 2:
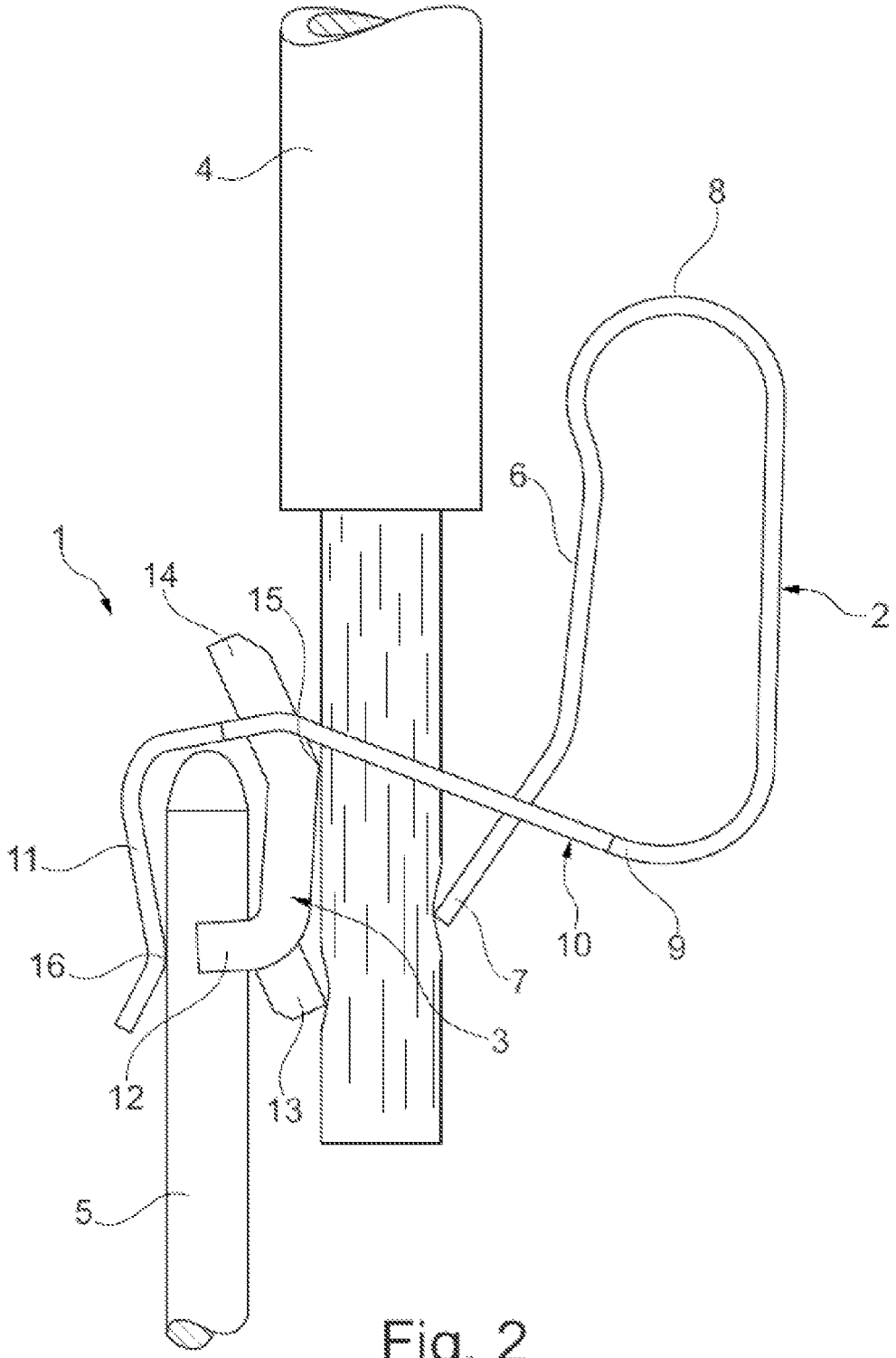
Figure 3:
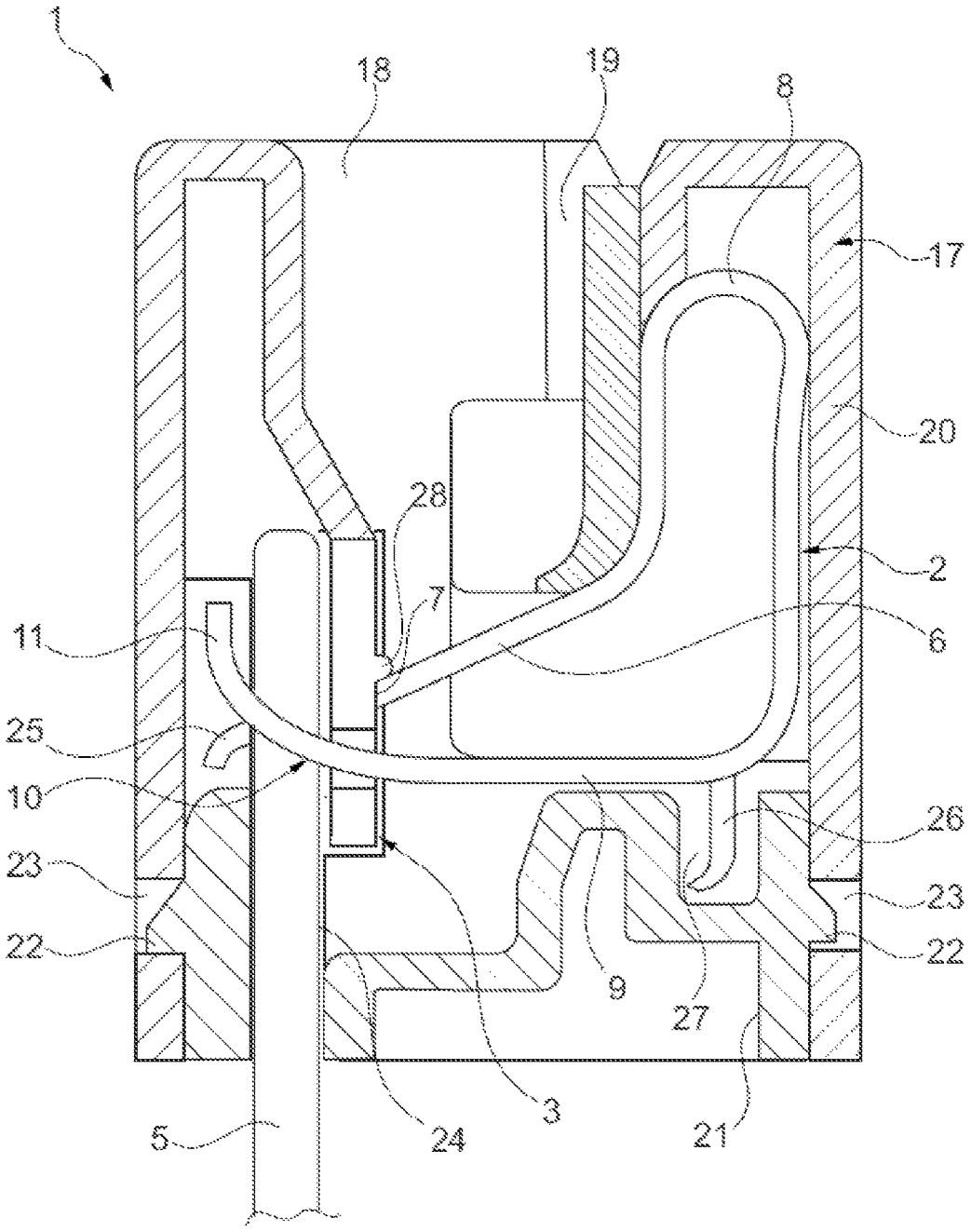
Figure 4:
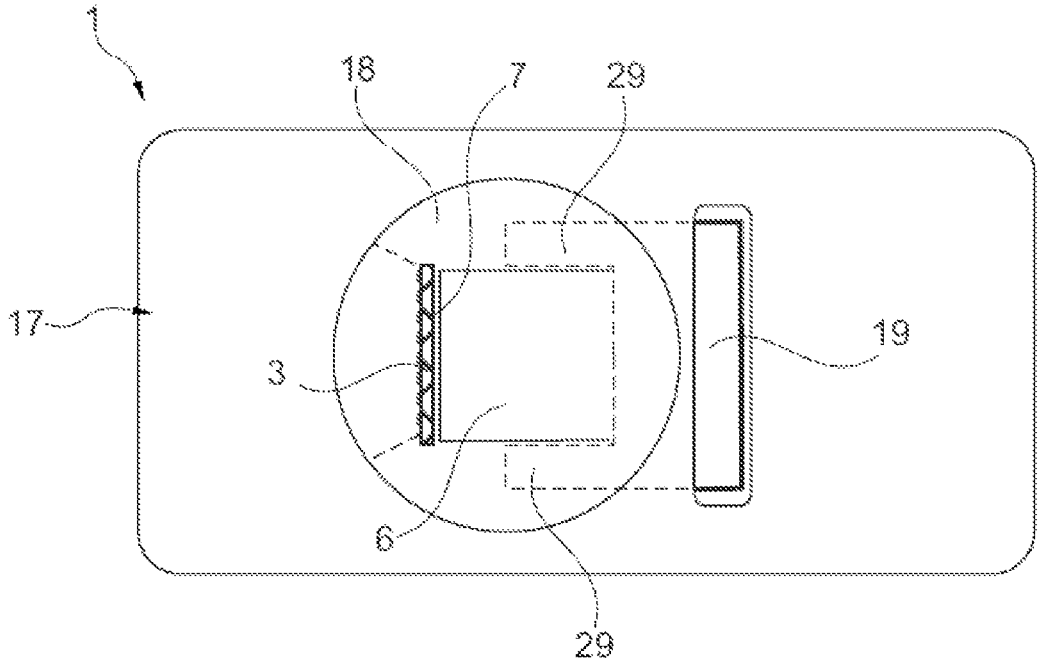
Figure 5:
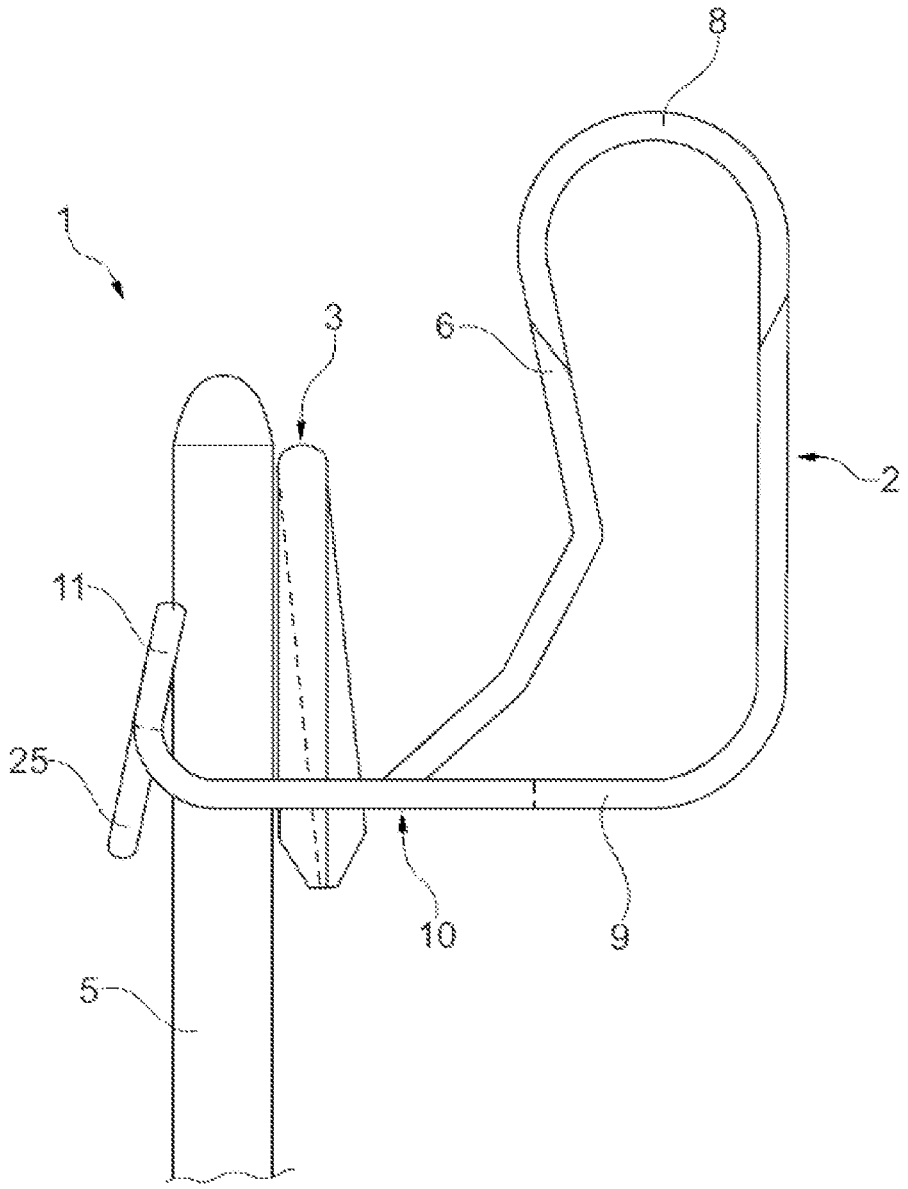
Figure 6:
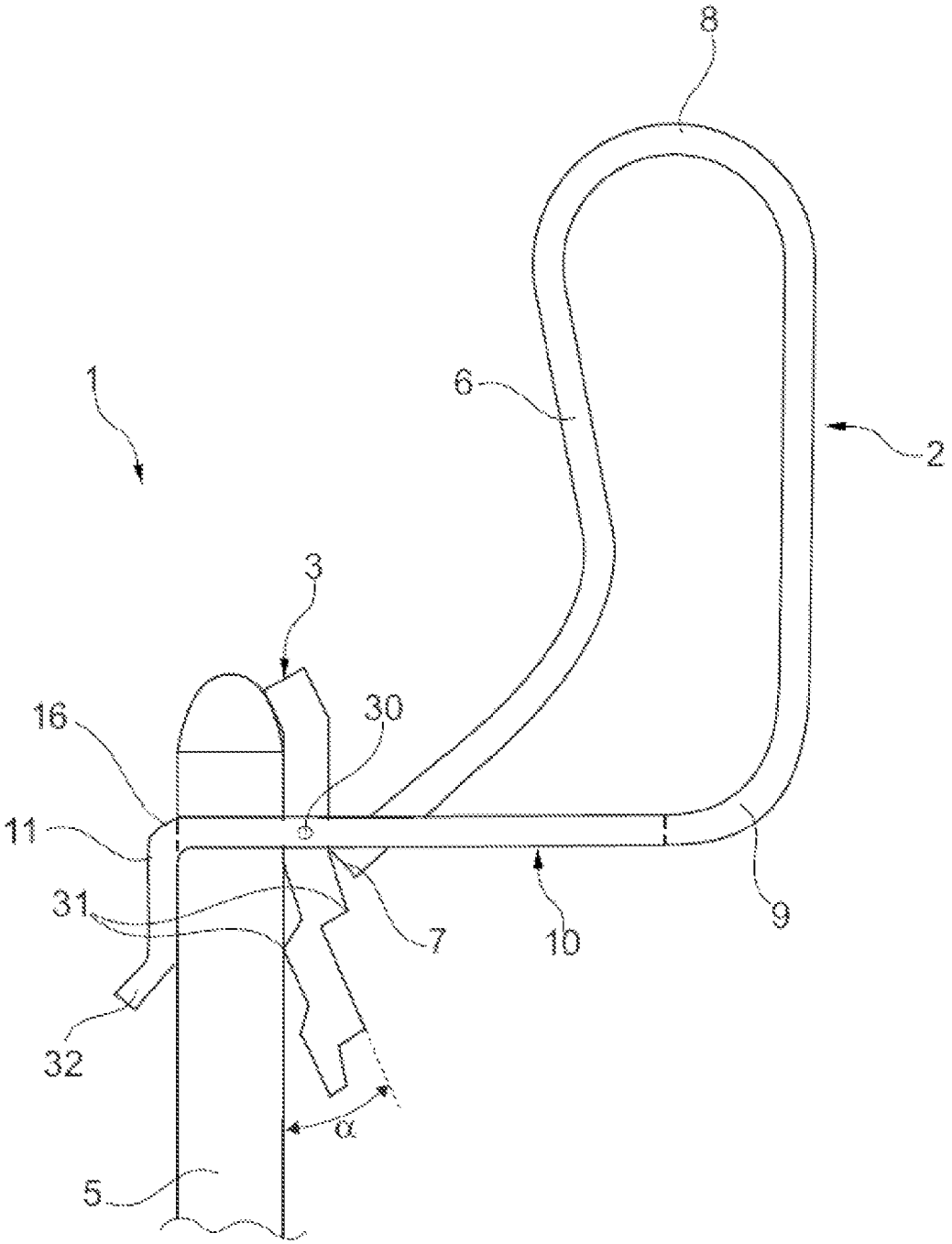
Figure 7:
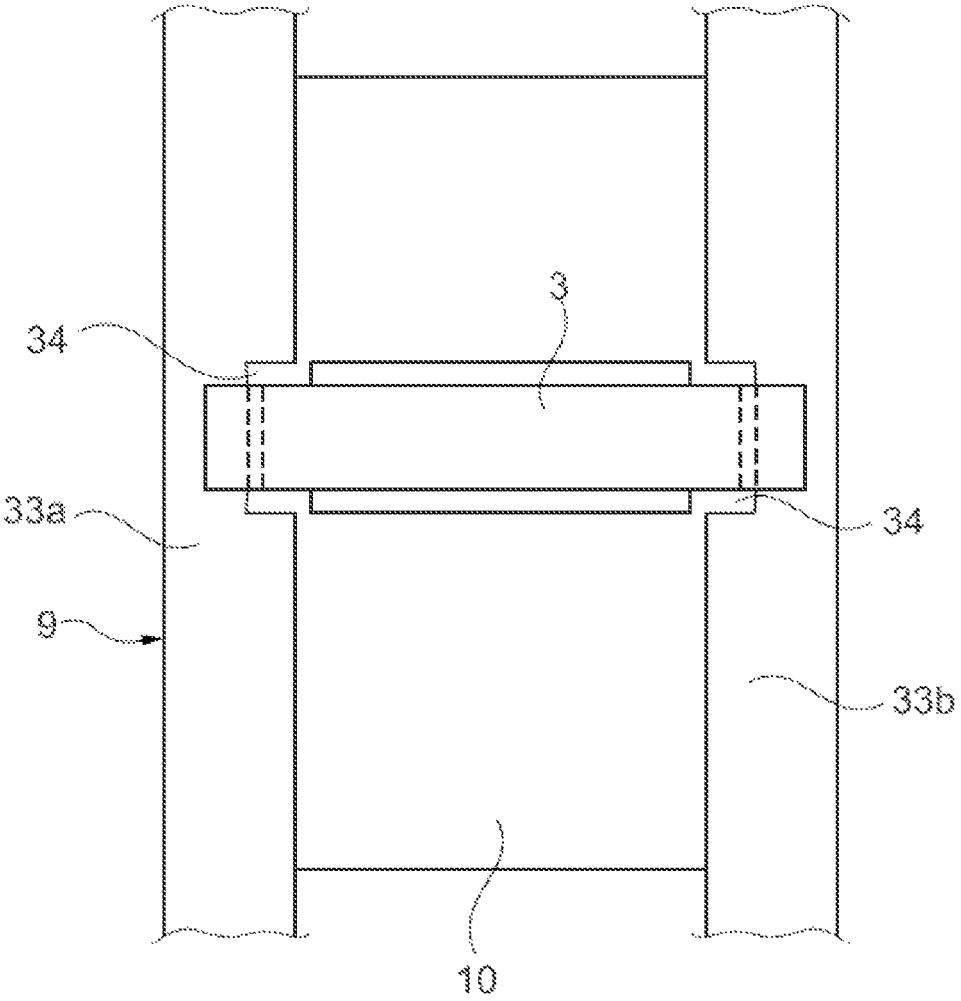
Figure 8:
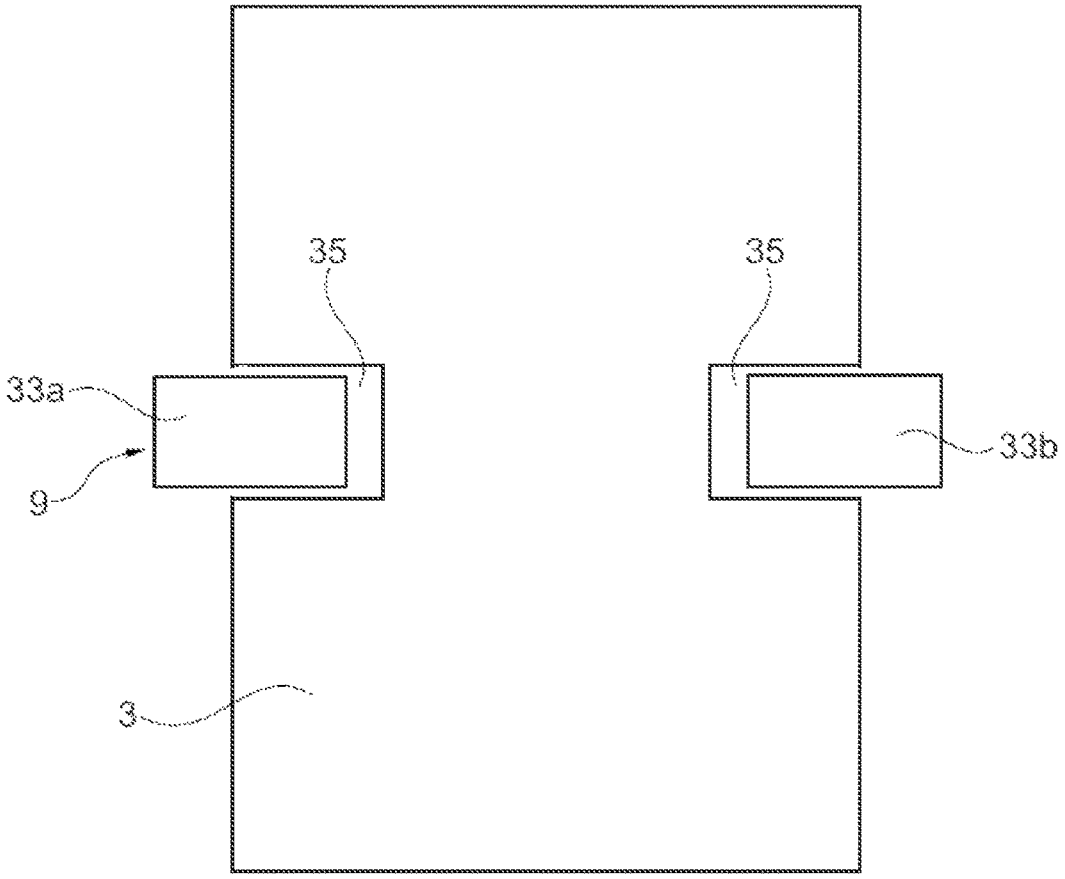
Figure 9:
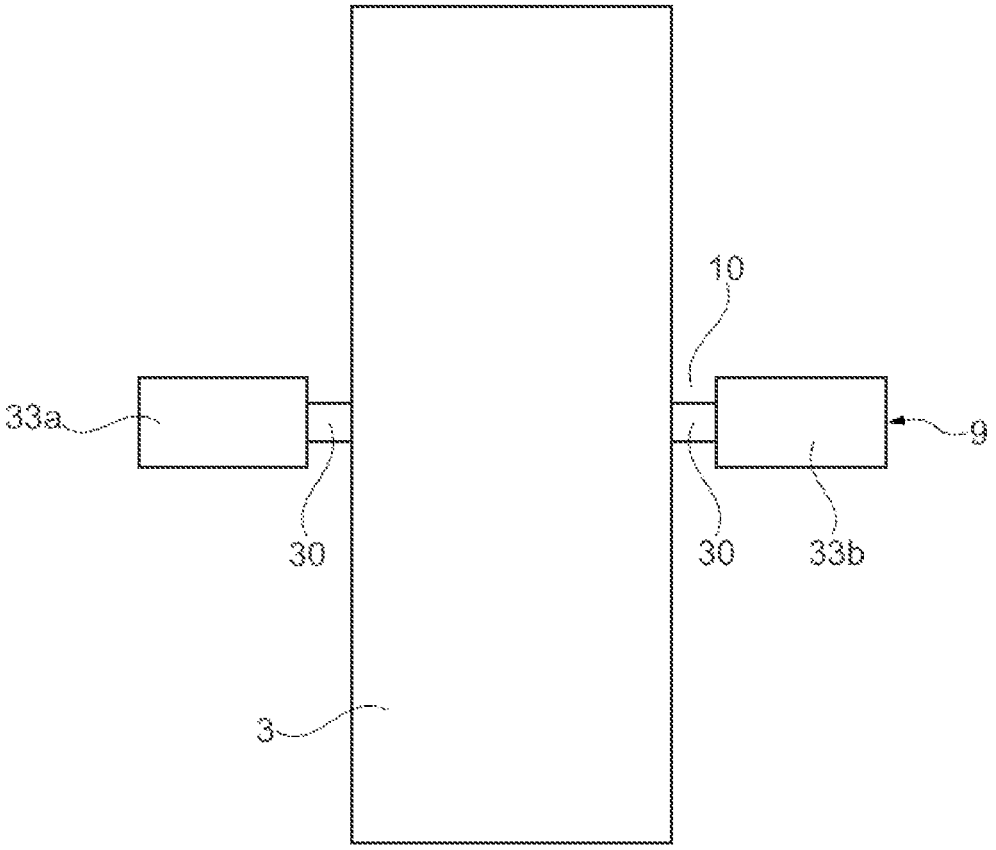
Figure 10:
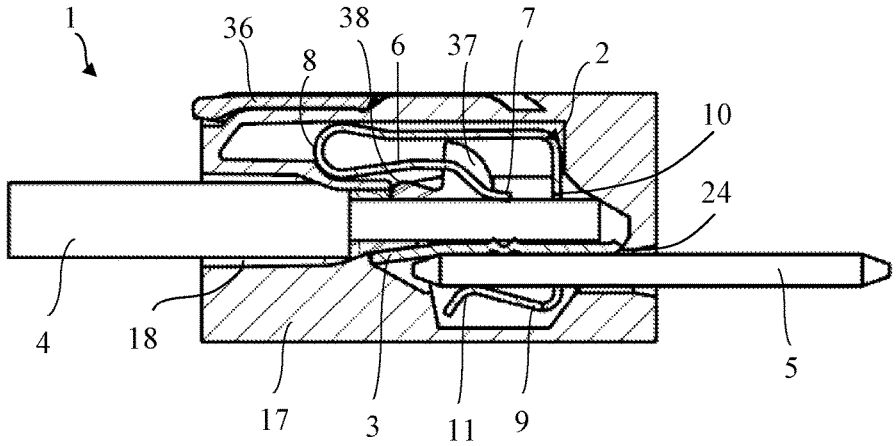
Figure 11:
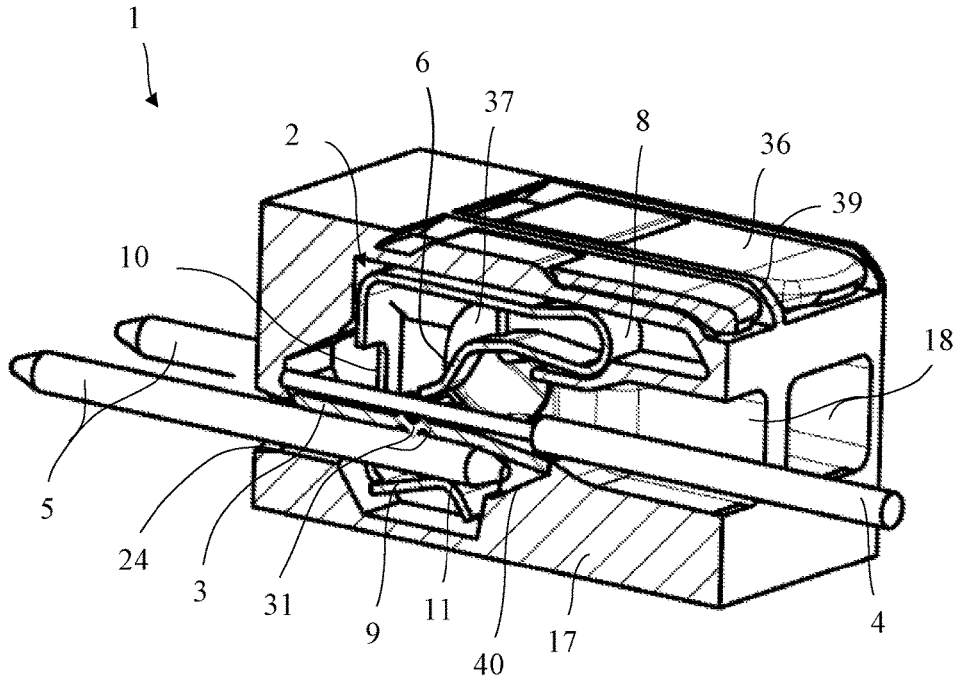
Figure 12:
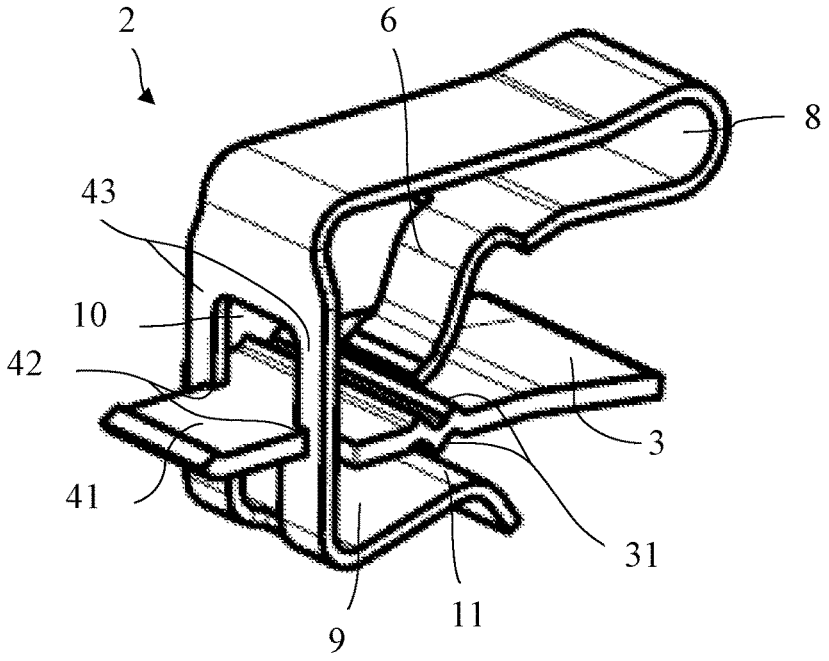
Figure 13:
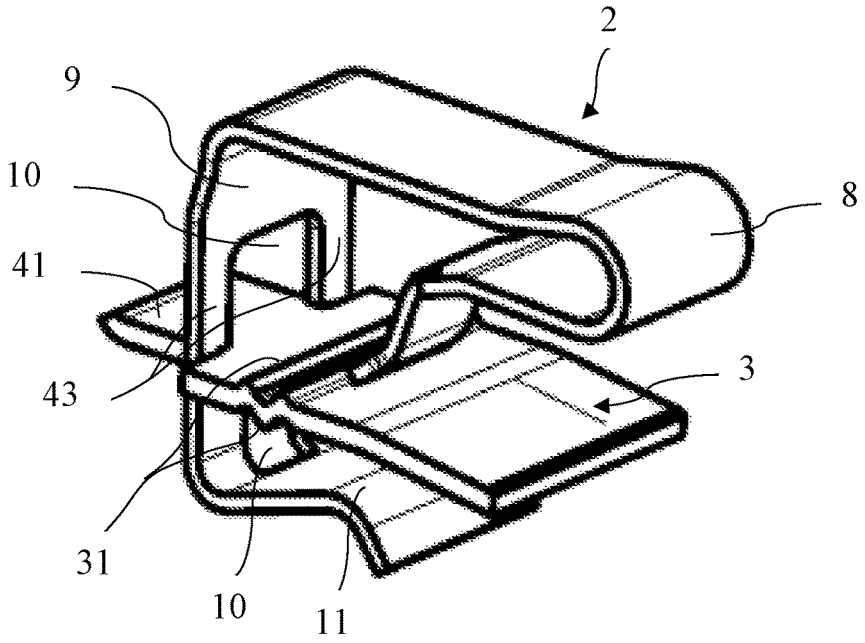
Figure 14:
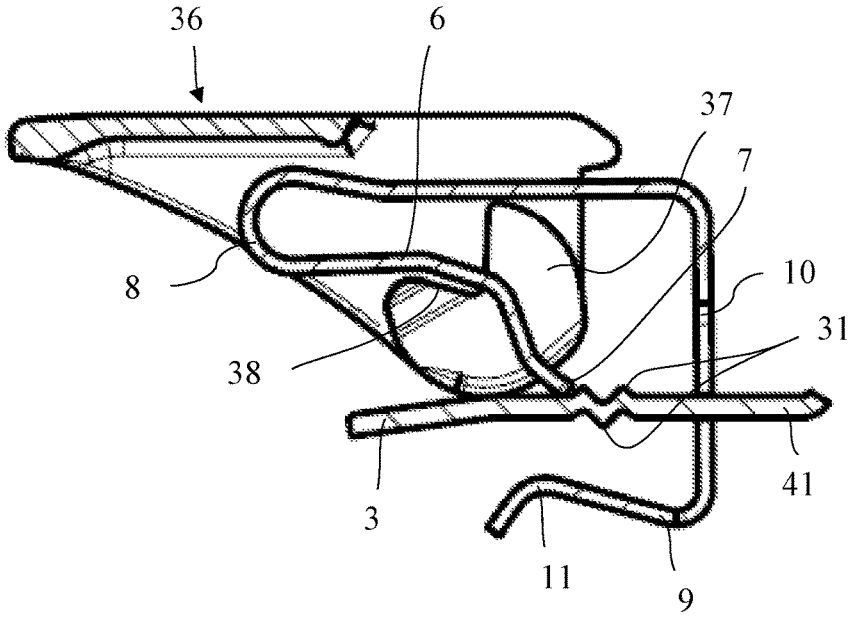
Figure 15:
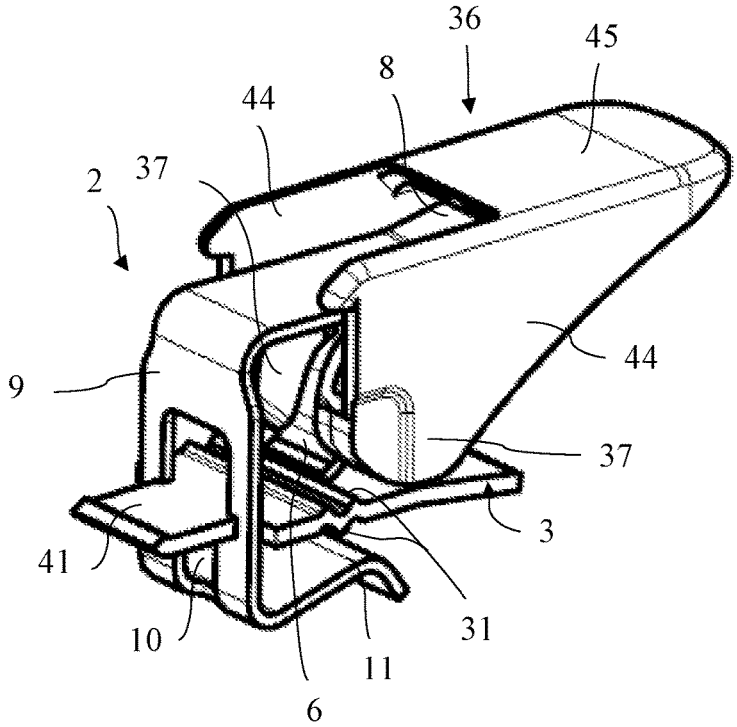
Figure 16:
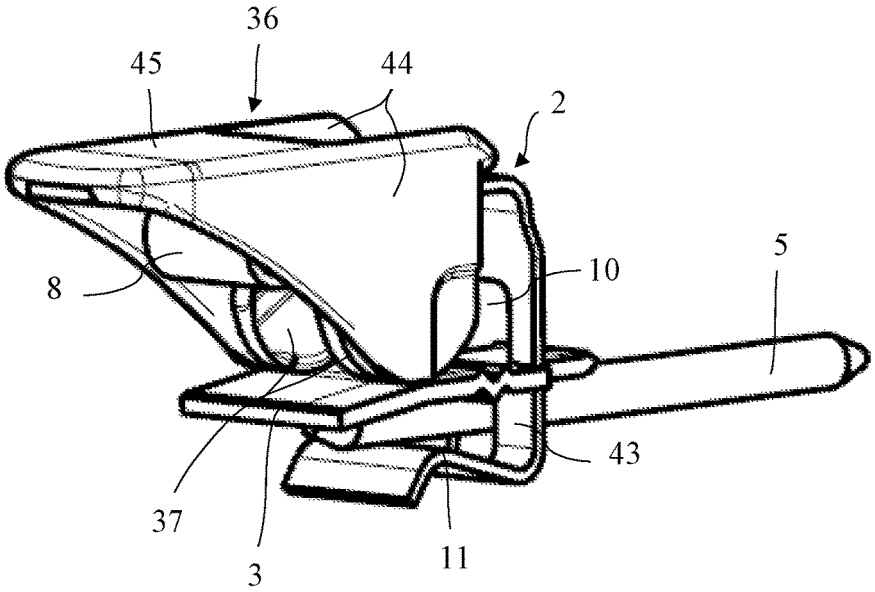
Figure 17:
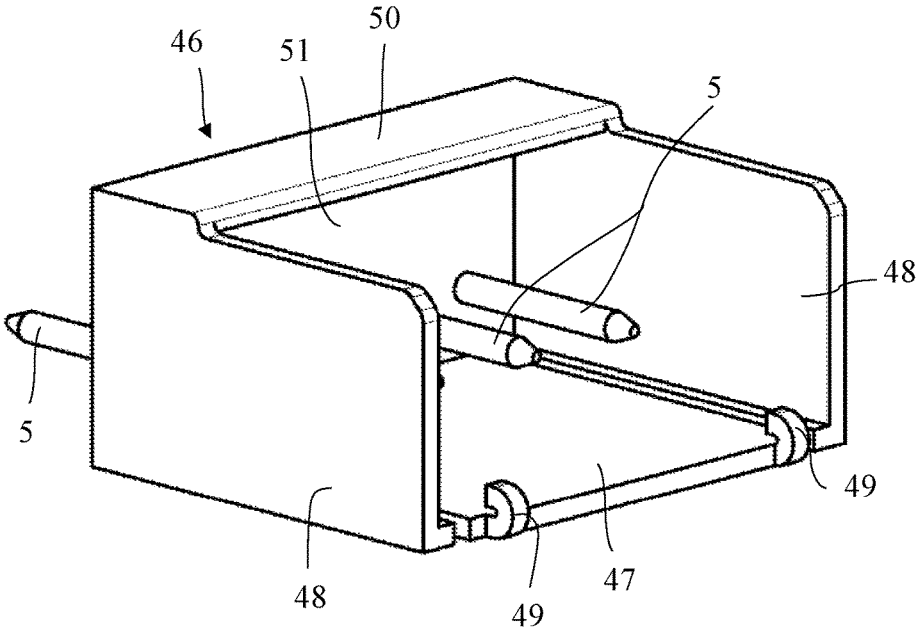
Figure 18:
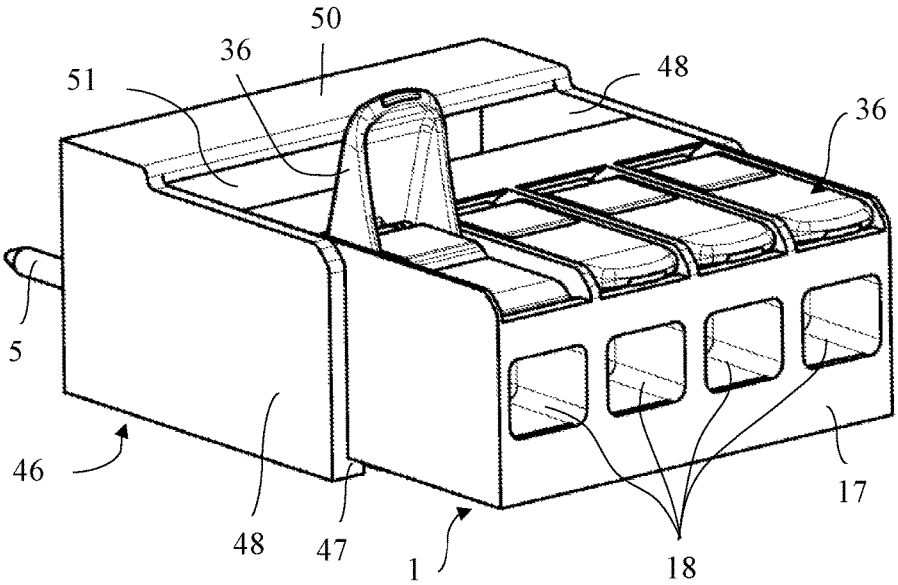
Figure 19:
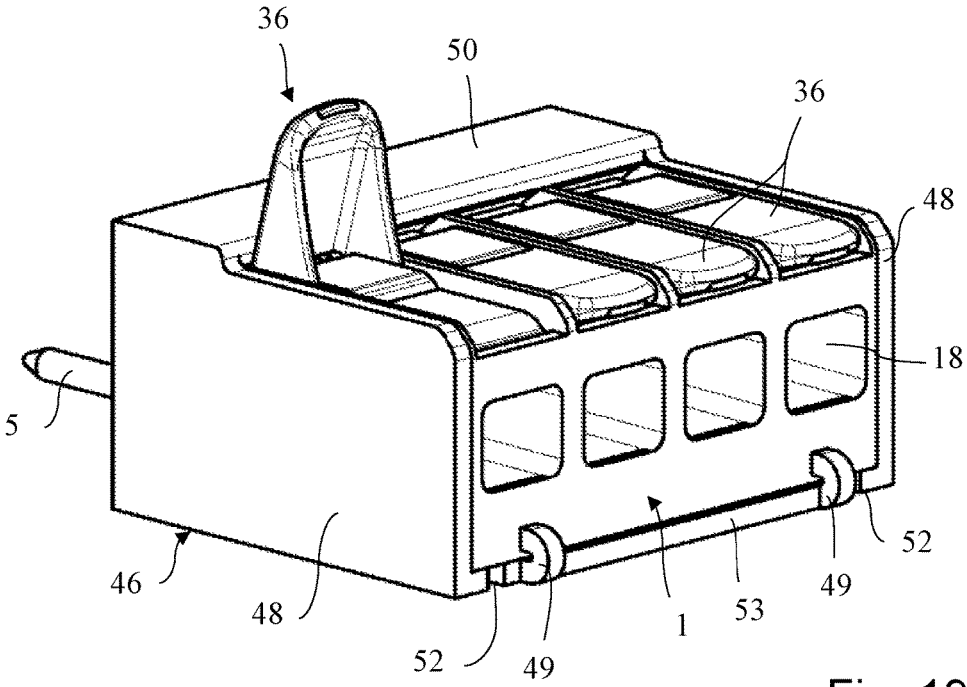
Figure 20:
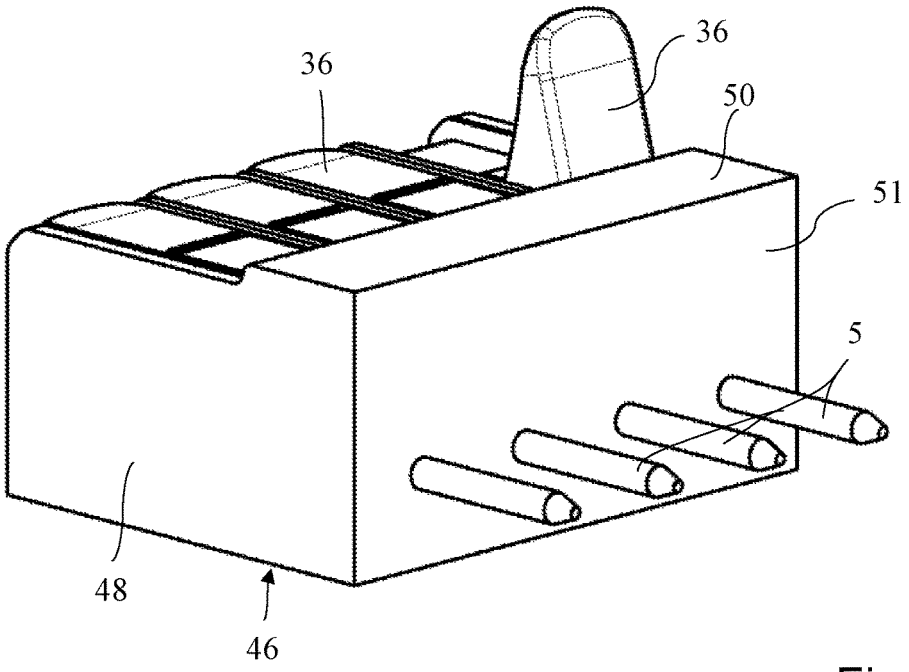
Figure 21:
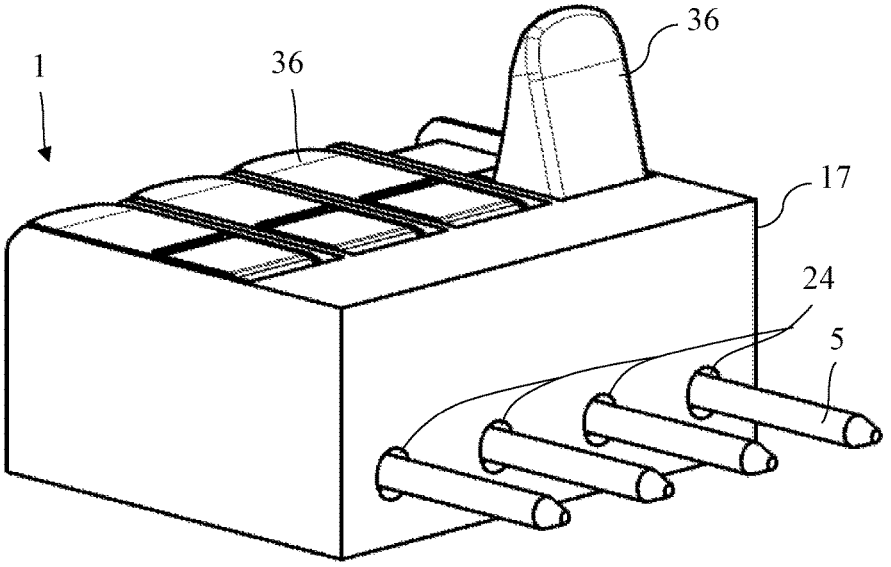

The invention is explained in detail below on the basis of exemplary embodiments with the attached drawings. They show:

FIG. 1—side view of a conductor terminal without insulating housing in the state prior to insertion;

FIG. 2—side view of the conductor terminal from FIG. 1 with inserted electrical conductor and contact pin;

FIG. 3—cross-sectional side view of a second embodiment of a conductor terminal with contact pin inserted;

FIG. 4—top view of the conductor terminal from FIG. 3 with the contact element projecting somewhat into the straight line of the conductor insertion opening;

FIG. 5—side view of a third embodiment of a conductor terminal without insulating housing with contact element movably supported in the feed-through opening of the support leg;

FIG. 6—side view of a fourth embodiment of a conductor terminal without insulating housing with contact element pivotably supported in the feed-through opening of the support leg;

FIG. 7—detail view in a top view of a section of the support leg in the region of the feed-through opening with contact element suspended therein in notches of the support leg;

FIG. 8—cross-sectional view of a different embodiment with the support leg projecting into notches of the contact element in the region of the feed-through opening;

FIG. 9—cross-sectional view of another embodiment of a contact element pivotably supported on the support leg;

FIG. 10—cross-sectional side view of a lever-operated conductor terminal with inserted electrical conductor and contact pin;

FIG. 11—perspective cross-sectional view of the conductor terminal from FIG. 10;

FIG. 12—perspective view of a clamping insert—composed of a clamping spring and a contact element—for the conductor terminal from FIGS. 10 and 11;

FIG. 13—perspective rear view of the clamping insert from FIG. 12;

FIG. 14—cross-sectional side view of the contact insert from FIGS. 12 and 13 with operating lever;

FIG. 15—perspective view of the contact insert with operating lever from FIG. 14;

FIG. 16—perspective front view of the contact insert from FIG. 15 with contact pin inserted;

FIG. 17—perspective view of a pin connector housing with built-in contact pins;

FIG. 18—perspective view of the pin connector housing from FIG. 17 with conductor terminal set in place;

FIG. 19—perspective view of the pin connector housing with conductor terminal inserted and locked;

FIG. 20—perspective rear view of the arrangement from FIG. 19 consisting of pin connector housing and inserted conductor terminal;

FIG. 21—perspective rear view of the conductor terminal with operating lever from FIG. 11 with contact pins inserted.

FIG. 1 shows a side view of a first embodiment of a conductor terminal without insulating housing. Visible here is the spring-loaded terminal connection composed of a clamping spring 2 and a contact element 3 for connecting an electrical conductor 4 from one side (from above) and a contact pin 5 from the opposite side (from below). In this view, the electrical conductor 4 with its stripped end and the contact pin 5 are in the state prior to insertion and have not yet been clamped to the spring-loaded terminal connection.

The clamping spring 2 has a clamping leg 6, which has, at its free end, a clamping edge 7 for clamping the stripped end of the electrical conductor 4. A "free end" is understood to be the end region where the clamping spring 2 terminates or ends.

The clamping leg 6 transitions into a spring bend 8 that is followed by a support leg 9. In the exemplary embodiment shown, the support leg 9 is bent yet again and extends toward clamping leg 6. In the bent support section, a feed-through opening 10 is present along the length indicated by dashes. The free end region of the clamping leg 6 projects into the feed-through opening 10, at least in the deflected state, and can project out of the feed-through opening 10 on the side opposite the spring bend 8, as shown.

Next to the feed-through opening 10, the free end of the support leg 9, which is opposite the clamping leg 6, is bent relative to the plane spanned by the feed-through opening 10 in order to form a clamping section 11 with the bent free end.

It can be seen that the contact element 3 is arranged in the feed-through opening 10 and projects out of the feed-through opening 10 on both sides. In the exemplary embodiment shown, the contact element is supported on the clamping section 11 of the support leg 9 by a bent support section 12. Here, the contact element 3 is pressed against the clamping section 11 of the support leg 9 by the clamping edge 7 of the clamping leg 6 due to the clamping force of the clamping spring 2. The spring-loaded terminal contact is thus self-supporting.

It can also be seen that, in the lower region of the clamping element 3, a guide section 13 is bent obliquely out of the plane of the clamping element 3 in the opposite direction from the support section 12. In this way, a funnel-shaped guide is created between contact element 3 and clamping section 11 of the support leg 9 of the clamping spring 2 for insertion of a contact pin 5 to be clamped.

In the upper region, the clamping element 3 is tapered in order for the tapered end section 14 to project through the feed-through opening 10. The adjoining section of the contact element 3, which is wider again, then rests against the side webs of the support leg 9 that delimit the feed-through opening 10.

FIG. 2 shows a side view of the conductor terminal 1 from FIG. 1 in the inserted state. Here, the electrical conductor 4 with its stripped end and also the contact pin 5 are inserted into the spring-loaded terminal connection in their respective clamping positions. It is evident that the stripped end of the electrical conductor 4 is pressed against the contact element 3 with the clamping leg 6. When this occurs, the clamping edge 7 on the free end of the contact leg 6 rests against the stripped end of the electrical conductor 4 and exerts a spring force in the direction of contact element 3. The electrical conductor is pressed at the same time against a contact edge on the guide section 13 and, adjacent to the feed-through opening 10, against an additional contact edge 15 produced by bending of the contact element 3. The clamping force of the clamping leg 6 of the clamping spring 2 resulting primarily from the spring bend 8 is thus concentrated on these defined contact points.

On the side of the contact element 3 opposite the electrical conductor 4, the contact pin 5 is inserted in the opposite direction, and placed between the clamping edge 11 and the contact element 13. The clamping section 11 of the support leg 9 has, on its free end region, a bend 16, with which is created, firstly, an entry funnel for the contact pin 5 and, secondly, a defined and reduced contact surface, with which the clamping section 11 transfers the spring force of the support leg 9 to the contact pin 5. Insertion of the contact pin 5 between clamping section 11 and contact element 3 causes the contact element 3 to be displaced toward clamping leg 6 relative to the clamping section 11 in that the support leg 9 experiences a deflection. As a result, both the stripped end of the electrical conductor 4 and the contact pin 5 are pressed against the contact element 3 by the opposing spring forces of the clamping leg 6 and the clamping section 11 of the clamping spring 2. An electric current is transferred between contact pin 5 and electrical conductor 4, on the shortest path through the contact element 3. This design has the result that the transition resistances are kept extremely small.

FIG. 3 shows a second embodiment of a conductor terminal 1, now in an insulating housing 17. Here, too, a clamping spring 2 is accommodated in the insulating housing 17, again in the manner of a loop spring. In the upper region, the insulating housing 17 has a conductor insertion opening 18, which leads to the clamping point—formed by the free end of the clamping leg 6 and the contact element 3—for clamping an electrical conductor 4. In the exemplary embodiment shown, an operating pusher 19 is movably built into the insulating housing 17 next to the conductor insertion opening 18. The operating pusher 19 rests against the clamping leg 6 in order to displace the clamping leg 6 toward support leg 9 to open the clamping point for the clamping or removal of an electrical conductor 4.

The insulating housing 17 is constructed in two parts, a top part 20 and a bottom part 21. The bottom part 21 has latches 22 that project into latch openings 23 of the top part 20 in order to lock the bottom part 21 to the top part 20. For assembly, first the spring-loaded terminal connection consisting of the clamping spring 2 and the contact element 3 is placed in the top part 20, as is the operating pusher 19. Next, the top part 20 is closed with the bottom part 21, which then locks to the top part 20.

In this exemplary embodiment as well, it can be seen that the contact element 3 is again passed through a feed-through opening 10 in the support leg of the clamping spring 2, and is thus supported on the support leg 9. The contact element 3 can be supported in a fixed position in the insulating housing 17 in this case. However, it should be supported on the support leg 9 such that it is movable or pivotable in the region of the feed-through opening 10 relative to the clamping spring 2, in particular in the direction in which the feed-through opening 10 and the support leg 9 extend.

It is evident that the contact pin 5, which is inserted into a contact pin insertion opening 24 of the insulating housing 17 from below, rests against the contact element 3. The contact pin 5 in this case is pressed against the contact element 3 by the clamping section 11 of the bent free end of the support leg 9. The clamping section 11, which is bent in the insertion direction of the contact pin 5, has a section 25 that is bent opposite the insertion direction of the contact pin 5, with which the clamping spring 2 is supported in the insulating housing 17. This section 25 is bent away from the contact pin 5 to be inserted and the contact pin entry opening 24 in the direction of the outside wall of the insulating housing 17 in order to thus form a funnel-shaped guide wall for the contact pin 5.

Moreover, on the side of the support section 9 opposite the clamping section 11 below the spring bend 8, a retaining tab 26 is bent downward from the support section 9 toward the bottom part 21 of the insulating housing 17. This retaining tab 26 projects into an associated cutout 27 of the bottom part 21 in order to provide a certain fixing in position of the clamping spring 2 in the insulating housing 17.

It can also be seen that the contact element 3 has a protrusion 28 on the side facing the clamping leg 6, which forms a contact edge for clamping an electrical conductor inserted into the conductor entry opening 18.

FIG. 4 shows a top view of the conductor terminal 1 from FIG. 3. It is evident that the conductor insertion opening 18 into the contact space leads to the clamping point, which is formed by the clamping leg 6—or the clamping edge 7 arranged on the free end section thereon—and the contact element 3, a part of the width of which projects into the straight line of the conductor insertion opening 18. The contact element 3 thus projects somewhat past the wall of the insulating housing 17 that delimits the conductor insertion opening 18.

It can also be seen that the operating pusher 19 has a section bent in a U-shape with two mutually opposing side webs 29, which constitute a part of the wall of the conductor insertion opening 18 and assist in guiding an electrical conductor 4. A crossbar of the operating pusher 19 rests on the clamping leg 6 in order to displace the clamping leg 6 in the direction of support leg 9 to open the clamping point when the operating element 19 is pressed down.

FIG. 5 shows a side view of a third embodiment of a conductor terminal 1, once again without insulating housing, with contact pin 5 inserted and clamped. Once more, the free end section of the support leg 9 is bent in the insertion direction (direction of extension) of the contact pin in order to form a clamping section 11. This clamping section 11 is oriented with its free end toward the contact pin 5 and the contact element 3 that is inserted in a feed-through opening 10 in the support leg 9, so that the contact pin 5 makes contact with a clamping edge at the end of the clamping section 11 and is pressed against the contact element 3.

At the free end section of the support leg 9, a section 25 is once again bent out in the opposite direction to the clamping section 11; this section is freed (for example, stamped free or cut free) from the sheet metal material of the support leg 9 when the feed-through opening 10 is formed. This section 25 extends obliquely away from the insertion direction of the contact pin 5 and serves to secure the clamping spring 2 in the insulating housing as well as to form an entry funnel for the contact pin.

The free end section of the clamping leg 6 of the clamping spring 2 again projects into the feed-through opening 10, at least in the deflected, inserted state, and is provided and oriented so as to clamp an electrical conductor 4 inserted between clamping leg 6 and contact element 3 against the contact element 3.

The contact element 3 is supported in the feed-through opening 10 so as to be movable relative thereto, as is indicated by the dashed lines. Preferably, a fixed support of the contact element 3 in the insulating housing is provided in this case.

FIG. 6 shows a different embodiment of the conductor terminal 1, in which the relatively short contact element 3 is again arranged in the feed-through opening 10 of the support leg 9. The contact element 3 in this design is supported in a fixed position but pivotably on the support leg 9 with bearing pins 30. In this way, the position of the contact element 3 can adapt to the clamping position and the action of spring force when the contact pin 5 and electrical conductor (not shown) are clamped. The pivot angle $\alpha$ for the contact element here is preferably in the range of up to 10 degrees, and especially preferably up to 5 degrees.

It is additionally evident that the contact element 3 has, both on the side provided for clamping an electrical conductor and on the side for clamping a contact pin 5, protrusions 31 that form a defined, reduced contact area, on which the clamping force of the clamping spring 2 is concentrated. As a result, the surface pressure is improved and the transition resistances are reduced.

In the exemplary embodiment shown, the clamping section 11 at the free end of the support leg 9 bent away from the plane of the feed-through opening 10 is now bent opposite the insertion direction of the contact pin 5. Once again, as in the first exemplary embodiment, a bend 16 is present so that the clamping section 11 ends with a section 32 projecting obliquely out of the contact pin entry opening.

Thus, as in the first exemplary embodiment, this section 32 forms a funnel-shaped guide surface for the contact pin 5 to be inserted.

FIG. 7 shows a detail view of a spring-loaded terminal connection in the region of the feed-through opening 10 of the support leg 9 of the clamping spring. This feed-through opening 10 is delimited by two mutually opposing side webs 33*a*, 33*b* of the clamping spring. On their lateral edges facing the feed-through opening 10, these side webs have notches 34, in which the contact element 3 is suspended by its free ends. The free ends in this case have a reduced width adapted to the notches 34 as compared to the width of the contact element 3 in the adjoining central main region.

In this way, the contact element 3 is supported in a fixed position, but nonetheless at least tiltably, on the support leg 9 in the direction in which the feed-through opening 10 and the support leg 9 extend.

FIG. 8 shows a reversed variant in a cross-sectional view of the clamping element 3 in the region of the feed-through opening. Once again, the feed-through opening is delimited by side webs 33*a*, 33*b* of the support leg 9 of the clamping spring. In this exemplary embodiment, the contact element 3 has, on the mutually opposing sides, notches 35 that the associated side webs 33*a*, 33*b* project into. In this way, the contact element 3 is movably supported on the support leg 9 in the direction of longitudinal extent of the support leg 9 or the feed-through opening 10 delimited by the side webs 33*a*, 33*b*. The contact element 3 is located in the feed-through opening in this case.

FIG. 9 shows another embodiment of the support of the contact element 3 as was used in the exemplary embodiment from FIG. 6. In this design, the contact element 3 is arranged in the feed-through opening 10 of the support leg 9 and is pivotably mounted on the support leg 9 with bearing pins 30.

The variants shown in FIGS. 7 to 9 of the support of the contact element 3 on the support leg 9 can fundamentally be used for all of the embodiments described above of the clamping springs 2 and contact elements 3.

FIG. 10 shows a cross-sectional side view of a conductor terminal 1 in which an operating lever 36 for each clamping spring 2 is pivotably supported in the insulating housing 17. The insulating housing has, on its front side, a conductor insertion opening 18, and on the opposing rear side, a contact pin insertion opening 24, which both lead to a common connection space in the insulating housing 17. The contact insert composed of the clamping spring 2 and the contact element is accommodated in this connection space. It is evident that the contact element 3 is inserted into a feed-through opening 10 of the support leg 9, through which opening the stripped end of the electrical conductor 4 is also inserted from one side as is the contact pin 5 from the opposite side. The contact element 3 is then located between the stripped end of the electrical conductor 4 and the contact pin 5.

The contact pin 5 rests against the clamping section 11 of the support leg 9 pointing obliquely toward the contact element 3. This clamping section 11 is resilient and exerts on the contact pin 5 a clamping force that is directed toward the opposite contact element 3. The free end of the support leg 9 is bent away from the contact element 3 in order to thus create a clamping section 11 with reduced contact area and to permit withdrawal of the contact pin 5.

The operating lever 36 has an operating section 37 that is shaped like a segment of a circle and is located laterally next to the clamping leg 6. When the operating lever 36 is flipped up, the operating section 37 rotates so that a carrier surface 38 comes into contact with the clamping leg 6 or a tab of material projecting laterally from the clamping leg, and moves the clamping leg away from the contact element 3 in the direction of the opposite part of the support section 9 adjoining the spring bend 8. In this way, the clamping point that is formed between the clamping edge 7 of the clamping spring 2 and the contact element 3 for clamping an electrical conductor 4 is opened.

It is evident that the spring bend 8 is located next to the conductor insertion opening 18 and the feed-through opening 10 of the support section 9 is located next to the contact pin entry opening 24.

It is also evident that the conductor insertion opening 18 and the contact pin insertion opening 24 are parallel to and offset from one another, with the contact element 3 being located between the straight line of the conductor insertion opening 18 and the straight line of the contact pin insertion opening 24.

FIG. 11 shows a perspective cross-sectional view of the conductor terminal 1 from FIG. 10. It is evident that the conductor terminal 1 has multiple clamping points arranged side by side, each for clamping one pair consisting of electrical conductor 4 and contact pin 5. Accordingly, multiple operating levers 36 are pivotably supported side by side in the insulating housing 17. The lever arms of the operating levers 36 can be separated from one another by intermediate webs 39. The free ends of the operating levers 36 are arranged next to the conductor insertion openings 18.

It is evident that the stripped end of the electrical conductor 4 and the contact pin 5 rest against protrusions 31 (projecting contact edges) of the contact element 3, so that the clamping force is concentrated on these protrusions 31. It can also be seen that the clamping leg 6 is routed laterally next to the operating section 37 of the operating lever 36, and the operating section 37 adjoins the boundary wall of the conductor insertion opening 18. This ensures a lateral guidance of the electrical conductor 4 by the operating section 37 of the operating lever 36.

It can furthermore be seen that the support leg 9 is bent in a box shape starting from the spring bend 8 in such a manner that a first section extends in the conductor insertion direction adjacent to the lever arm of the operating lever 36, then extends at right angles to the conductor insertion direction or the direction of extent of the conductor insertion opening 18 and the contact pin insertion opening 24, and then its free end region is bent in order to form there the clamping section 11 for the contact pin 5. The feed-through opening 10 is placed in the section extending at right angles to the conductor insertion and contact pin insertion direction. The feed-through opening 10 has a larger width in the straight line of the conductor insertion opening 18 than in the lower region in the straight line of the contact pin insertion opening 24. This creates a support for the contact element 3 and ensures that the contact pin insertion opening 24 remains clear, even with no contact pin 5 inserted. The contact element 3 is located next to the conductor insertion opening 18 on an inclined surface 40 of the insulating housing and is bent somewhat obliquely downward toward the straight line of the contact pin insertion opening 24 and away from the spring bend 8. As a result, the contact element 3 is held in its position at least to the extent that the contact pin insertion opening 24 remains clear when conductor terminal 1 is unoccupied, and an electrical conductor 4 can be inserted using the contact element 3 as a guide surface toward the clamping point.

FIG. 12 shows a perspective view of the clamping insert composed of the clamping spring 2 and the contact element 3. It is evident here that the contact element 3 is inserted in the pass-through opening 10 of the clamping spring 2. For this purpose, the contact element 3 has a protruding tongue 41 with a reduced width as compared to the contact region of the contact element 3. It can be seen, furthermore, that this tongue 41 has cutouts or notches 42 on the mutually opposing narrow sides; the side webs 43 of the support leg 9 that delimit the feed-through opening 10 project into said cutouts or notches. As a result, the contact element 3 is fixed in place in its position on the clamping spring 2 with respect to its direction of longitudinal extent. It can be seen, furthermore, that the width of the feed-through opening 10 is reduced stepwise toward the clamping section 11, so that the width of the feed-through opening 10 is greater above the clamping element 3 than in the region below the clamping element 3 on the side facing the clamping section 11. The clamping element 3 can thus be supported on the shoulder forming the stepped width of the feed-through opening 10.

FIG. 13 shows a perspective rear view of the clamping insert from FIG. 12. Here it is evident once again that the tongue 41 of the clamping element 3 is placed in the feed-through opening 10 and in this case is supported on a shoulder of the feed-through opening at the side webs 43.

FIG. 14 shows a cross-sectional side view of the clamping insert from FIGS. 12 and 13 with operating lever 36. It is evident that the operating section 37 of the operating lever 36 is shaped like a segment of a circle and is positioned laterally next to the clamping leg 6. By means of a wedge-shaped cutout in the operating section 37, an operating surface 38 is created that engages the clamping leg 6 or a tab of material projecting from the clamping leg 6 in order to move it away from the clamping element 3 in opposition to the spring force. The face, which is shaped like a segment of a circle, of the operating section 37 can rest on the contact element 3 in order to thus capture the operating force in the (self-supporting) contact insert and transfer as little force as possible to the insulating housing 17.

It can additionally be seen that the clamping leg 6 is bent down in the direction of the contact element 3 after a first section that adjoins the spring bend 8, and the free end of the clamping leg 6 carrying the clamping edge 7 is bent back again somewhat in the direction of feed-through opening 10.

It is also evident that the protrusions 31 on the contact element 3 are composed of serration-like projections with grooves adjoining and/or located between them, which are produced by a forming process, for example.

FIG. 15 shows a perspective rear view of the contact insert from FIG. 14. It is evident here that the clamping spring with its spring bend 8 and of the adjoining support leg 9 and, in particular, of the clamping leg 6 is bordered on both sides by side walls 44 of the operating lever 36. These side walls 44 are conically tapered toward the free end and are connected to one another by a top plate 45. This top plate 45 constitutes the lever arm of the operating lever 36, which is stabilized by the side walls 44, which conically widen in the direction of the clamping point. The interior thus formed of the operating lever 36 assists in accommodating the clamping spring 2 and guiding the electrical conductor. Located on each of the two sides of the clamping leg 6 is an operating section 37 that is shaped like a segment of a circle and is supported on the contact element 3.

FIG. 16 shows a perspective front view of the contact insert from FIG. 15. It is evident here that the spring bend 8 of the clamping spring is located beneath the top plate 15 of the operating lever 36. The operating lever 36 thus at least partially encloses the clamping spring 2 and is arranged adjacent to the lateral edges of the clamping spring 2.

FIG. 17 shows a perspective view of a pin connector housing 46 which consists of an insulating housing with contact pins 5 installed therein. The pin connector housing 46 has a bottom plate 47, from which a side wall 48 projects on each of the mutually opposite sides. The front and upper side of the pin connector housing is largely open, and the contact pins 5 project into this free space. At the front side of the bottom plate 47, locking tabs 49, which are curved in a U-shape by way of example, project upward.

On the side opposite the bottom plate 47, the side walls 48 are connected to one another by a top web 50. On the rear side, the pin connector housing is connected by a base plate 51. The contact pins 5 are passed through the base plate 51 and fixed in place in the base plate 51.

FIG. 18 shows a perspective view of the pin connector housing 46 with conductor terminal 1 set in place thereon. The conductor terminal 1 is then pushed onto the contact pins 5 and inserted into the pin connector housing 46 and laterally guided by the side walls 48. It can be seen that one of the multiple operating levers 36 is flipped up in order to thus open the clamping point of the associated clamping insert in the interior.

The operating levers 36 here are on the side that faces away from the bottom plate 47.

FIG. 19 shows a perspective view of the arrangement consisting of pin connector housing 46 with conductor terminal 1 now fully inserted. Here, the locking tabs 49 on the front of the pin connector housing 46 have sprung back such that they rest against the front of the conductor terminal 1 and form a stop. As a result, the conductor terminal 1 cannot simply be pulled out of the pin connector housing 46. The locking tabs 49 are located on a web 53 of the bottom plate 47 that is partially exposed by cutouts 52. To remove the conductor terminal 1, this web 53 must be bent away such that the locking tabs 49 expose the adjacent conductor terminal 1. To this end, a screwdriver, for example, can be inserted in the gap between conductor terminal 1 and web 53 in order to move the web 53 and the locking tabs 49 and pry out the conductor terminal 1.

FIG. 20 shows a perspective rear view of the arrangement from FIG. 19. It is evident here that the contact pins 5 are accommodated in the base plate 51 without gaps.

It can also be seen that, in the inserted state, the open operating levers 36 are adjacent to the connecting web 50, that the operating levers 36 can be flipped up fully, as shown in one example.

FIG. 21 shows a perspective rear view of the conductor terminal 1 with inserted contact pins 5. It is evident here that a gap is present between each of the contact pins 5 and the insulating housing 17 in the region of the contact pin insertion opening 24. These contact pins 5 thus are not fixed in place on the insulating housing 17 of the conductor terminal 1. Such fixing in place of the contact pins 5 is only provided for the pin connector housing 46 (see FIG. 20).

The invention claimed is:

1. A conductor terminal comprising:

an insulating housing that has a conductor insertion opening for inserting an electrical conductor and a contact pin insertion opening for inserting a contact pin; and a clamping spring for clamping the electrical conductor, wherein the clamping spring has a clamping leg with a clamping edge oriented so as to rest against the electrical conductor to be clamped, has a spring bend, and has a support leg, wherein the conductor insertion opening leads to the clamping edge in order to guide the electrical conductor to a clamping point formed by the clamping edge, wherein the contact pin insertion opening extends into an interior of the insulating housing in an opposite direction to the conductor insertion opening and leads to the support leg in order to guide the contact pin to rest against the support leg, wherein the support leg has a feed-through opening, wherein a contact element is arranged on the clamping spring in the feed-through opening of the support leg between the inserted electrical conductor and the inserted contact pin, and wherein the free end section of the support leg forms a clamping section for clamping the inserted contact pin between the clamping section and the contact element.

2. The conductor terminal according to claim 1, wherein the clamping section is a section of the support leg that is bent away from the plane spanned by the support leg in the region of the feed-through opening.

3. The conductor terminal according to claim 1, wherein the free end section of the support leg is bent in the insertion direction of the contact pin or opposite the insertion direction of the contact pin.

4. The conductor terminal according to claim 1, wherein the contact element is arranged in the insulating housing in a fixed position or with a limited mobility, and in that the support leg is movable relative to the contact element.

5. The conductor terminal according to claim 1, wherein the contact element has at least one contact projection on the contact side of the contact element facing the electrical conductor and/or the contact pin.

6. The conductor terminal according to claim 1, wherein the contact element is connected in an electrically conductive manner solely to the clamping spring and, in the clamped state, to an electrical conductor and a contact pin.

7. The conductor terminal according to claim 1, wherein the contact element is pivotably supported in the feed-through opening in a fixed position relative to the support leg.

8. The conductor terminal according to claim 1, wherein the contact element is movably supported in the feed-through opening.

9. The conductor terminal according to claim 1, wherein the contact element has, on its mutually opposing faces, notches for accommodating the side webs of the support leg of the clamping spring that delimit the feed-through opening.

10. The conductor terminal according to claim 1, wherein the conductor terminal is multipole and has a number of clamping springs with associated conductor insertion openings and contact pin insertion openings that corresponds to the number of poles.

11. The conductor terminal according to claim 1, wherein at least one operating lever is pivotably supported in the insulating housing for applying force to an associated clamping leg.

12. Arrangement composed of a conductor terminal according to claim 1 and a pin connector housing, wherein the contact pins are built into the pin connector housing and the pin connector housing is designed to accommodate the conductor terminal.

* * * * *